US005216188A

United States Patent [19]

Shibukawa

[11] Patent Number: 5,216,188

[45] Date of Patent: Jun. 1, 1993

[54] AUTOMATIC ACCOMPANIMENT APPARATUS

[75] Inventor: Takeo Shibukawa, Hamamatsu, Japan

[73] Assignee: Yamaha Corporation, Hamamatsu, Japan

[21] Appl. No.: 842,252

[22] Filed: Feb. 27, 1992

[30] Foreign Application Priority Data

Mar. 1, 1991 [JP] Japan ..... 3-36432

[51] Int. Cl.[5] ..... G10H 1/38; G10H 7/00

[52] U.S. Cl. ..... 84/637; 84/DIG. 22

[58] Field of Search ..... 84/613, 637, DIG. 22

[56] References Cited

FOREIGN PATENT DOCUMENTS 2179690 7/1990 Japan .

*Primary Examiner*—Stanley J. Witkowski

*Attorney, Agent, or Firm*—Spensley Horn Jubas & Lubitz

[57] ABSTRACT

An automatic accompaniment apparatus is adopted to a keyboard-type electronic musical instrument. Herein, the chord constituent notes and bass note of the subharmonic chord (or fractional chord) are detected and separated from the notes which are designated by the performer who depresses the keys of the keyboard. In response to certain chord note, particularly root of the chord, the desirable chord pattern (or chord type) is selected from the predetermined chord patterns memorized in a data table. This data table can be memorized with relatively small memory capacity. Thus, it is possible to accurately detect the subharmonic chord with small memory capacity. Then, the desirable subharmonic chord is automatically sounded as the accompaniment in accordance with the selected chord pattern and the detected bass note.

4 Claims, 9 Drawing Sheets

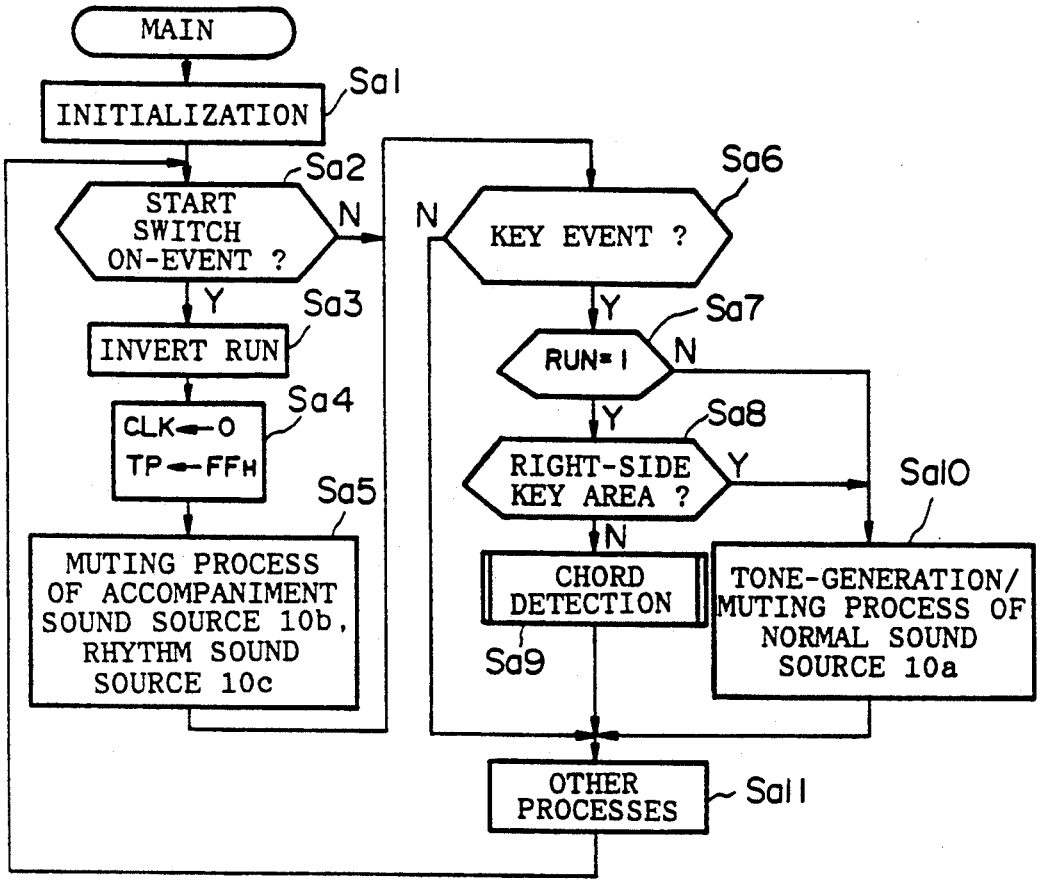
FIG.2 (MAIN ROUTINE)

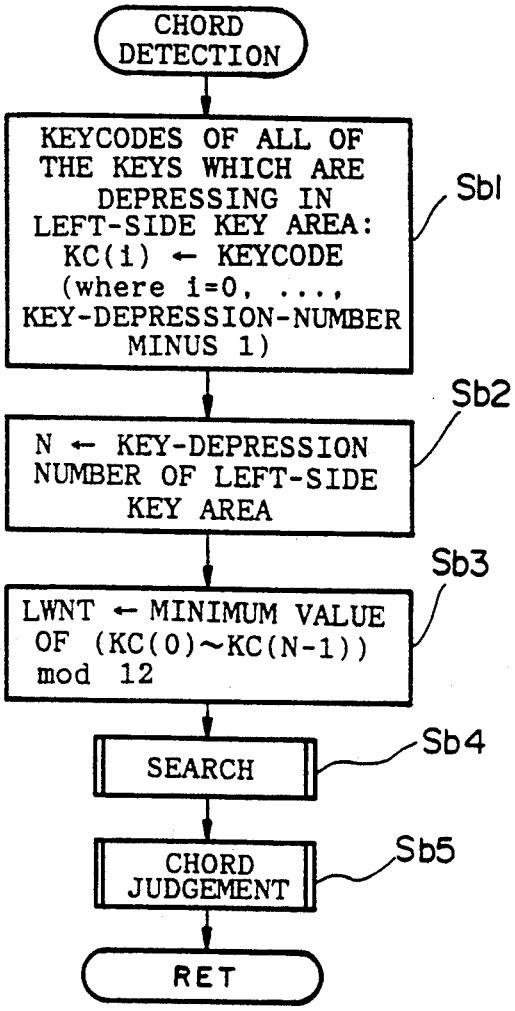
FIG.3 (CHORD DETECTION ROUTINE)

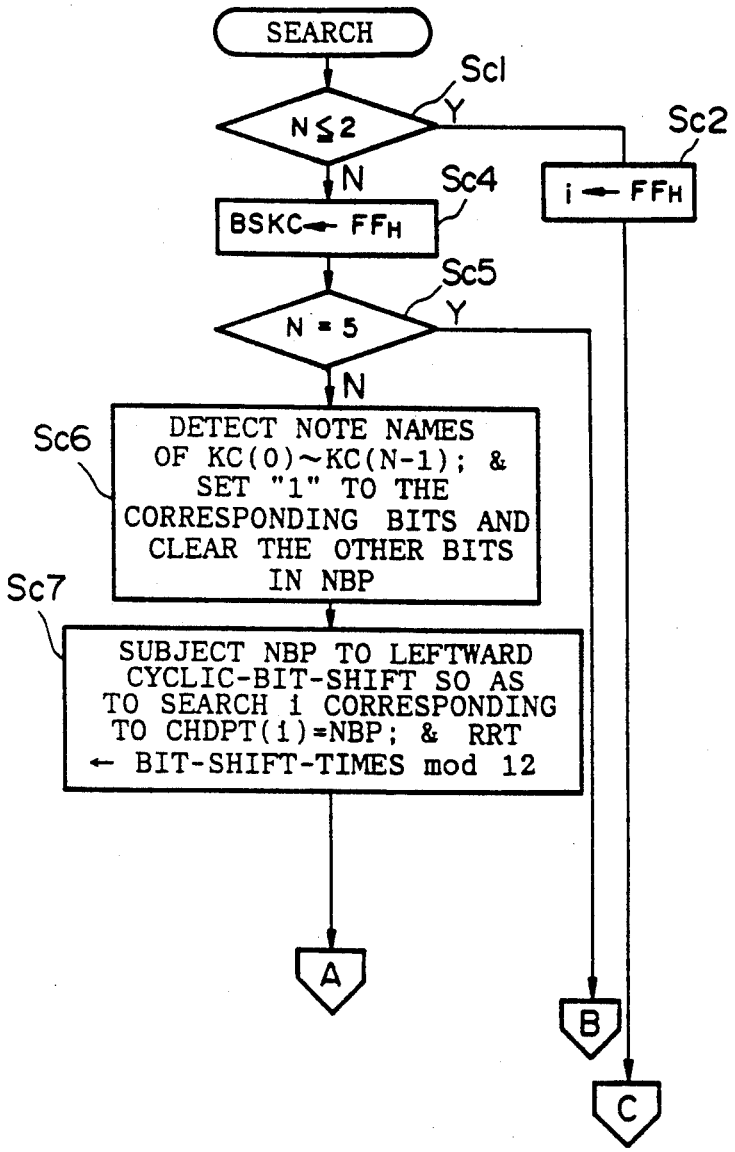
FIG.4 (SEARCH ROUTINE -part I-)

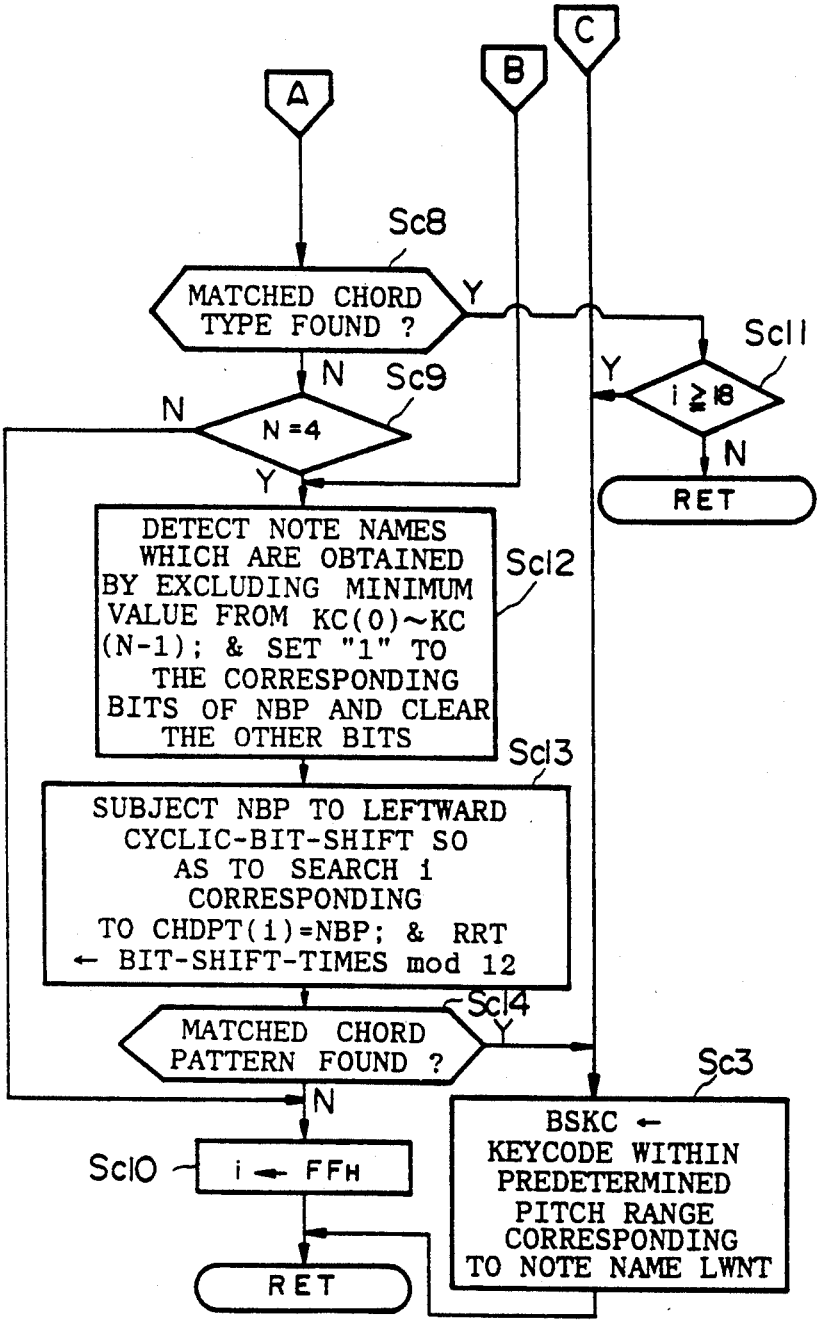
FIG.5 (SEARCH ROUTINE -part II-)

| i | CHORD -TYPE NAME | BIT / DEGREE | 0 | 1 | 2 | 3 | 4 | 5 | 6 | 7 | 8 | 9 | 10 | 11 | CHORD | |
|---|---|---|---|---|---|---|---|---|---|---|---|---|---|---|---|---|
| | | | 1 | 1# | 2 | 2# | 3 | 4 | 4# | 5 | 5# | 6 | 6# | 7 | ROOT RT | TYPE TP |
| 0 | Maj | | 1 | 0 | 0 | 0 | 1 | 0 | 0 | 1 | 0 | 0 | 0 | 0 | RRT | 0 |
| 1 | m | | 1 | 0 | 0 | 1 | 0 | 0 | 0 | 1 | 0 | 0 | 0 | 0 | RRT | 1 |
| 2 | 7th | | 1 | 0 | 0 | 0 | 1 | 0 | 0 | 1 | 0 | 0 | 1 | 0 | RRT | 2 |
| 3 | M7th | | 1 | 0 | 0 | 0 | 1 | 0 | 0 | 1 | 0 | 0 | 0 | 1 | RRT | 3 |
| 4 | 6th (m7th-5) | | 1 | 0 | 0 | 0 | 1 | 0 | 0 | 1 | 0 | 1 | 0 | 0 | RRT (RRT+1) mod12 | 4 18 |
| 5 | mM7th | | 1 | 0 | 0 | 1 | 0 | 0 | 0 | 1 | 0 | 0 | 0 | 1 | RRT | 5 |
| 6 | m6th (m7th-5) | | 1 | 0 | 0 | 1 | 0 | 0 | 0 | 1 | 0 | 1 | 0 | 0 | RRT (RRT+6) mod12 | 6 19 |
| 7 | M-5 | | 1 | 0 | 0 | 0 | 1 | 0 | 1 | 0 | 0 | 0 | 0 | 0 | RRT | 7 |
| 8 | 7th-5 | | 1 | 0 | 0 | 0 | 1 | 0 | 1 | 0 | 0 | 0 | 1 | 0 | RRT(RRT +6)mod12 | 8 |
| 9 | M7th-5 | | 1 | 0 | 0 | 0 | 1 | 0 | 1 | 0 | 0 | 0 | 0 | 1 | RRT | 9 |
| 10 | m-5 | | 1 | 0 | 0 | 1 | 0 | 0 | 1 | 0 | 0 | 0 | 0 | 0 | RRT | 10 |
| 11 | dim=m6th-5 | | 1 | 0 | 0 | 1 | 0 | 0 | 1 | 0 | 0 | 1 | 0 | 0 | LWNT | 11 |
| 12 | mM7-5 | | 1 | 0 | 0 | 1 | 0 | 0 | 1 | 0 | 0 | 0 | 0 | 1 | RRT | 12 |
| 13 | M+5=aug | | 1 | 0 | 0 | 0 | 1 | 0 | 0 | 0 | 1 | 0 | 0 | 0 | LWNT | 13 |
| 14 | 7th+5 | | 1 | 0 | 0 | 0 | 1 | 0 | 0 | 0 | 1 | 0 | 1 | 0 | RRT | 14 |
| 15 | M7th+5 | | 1 | 0 | 0 | 0 | 1 | 0 | 0 | 0 | 1 | 0 | 0 | 1 | RRT | 15 |
| 16 | sus4 (inharmonic4) | | 1 | 0 | 0 | 0 | 0 | 1 | 0 | 1 | 0 | 0 | 0 | 0 | RRT LWNT | 16 20 |
| 17 | 7thsus4 | | 1 | 0 | 0 | 0 | 0 | 1 | 0 | 1 | 0 | 0 | 1 | 0 | RRT | 17 |
| 18 | inharmonic1 | | 1 | 1 | 1 | 0 | 0 | 0 | 0 | 0 | 0 | 0 | 0 | 0 | LWNT | 21 |
| 19 | inharmonic2 | | 1 | 1 | 0 | 1 | 0 | 0 | 0 | 0 | 0 | 0 | 0 | 0 | LWNT | 22 |
| 20 | inharmonic3 | | 1 | 1 | 0 | 0 | 1 | 0 | 0 | 0 | 0 | 0 | 0 | 0 | LWNT | 23 |

FIG.6 (TABLE OF DETECTION PATTERN INFORMATION P1)

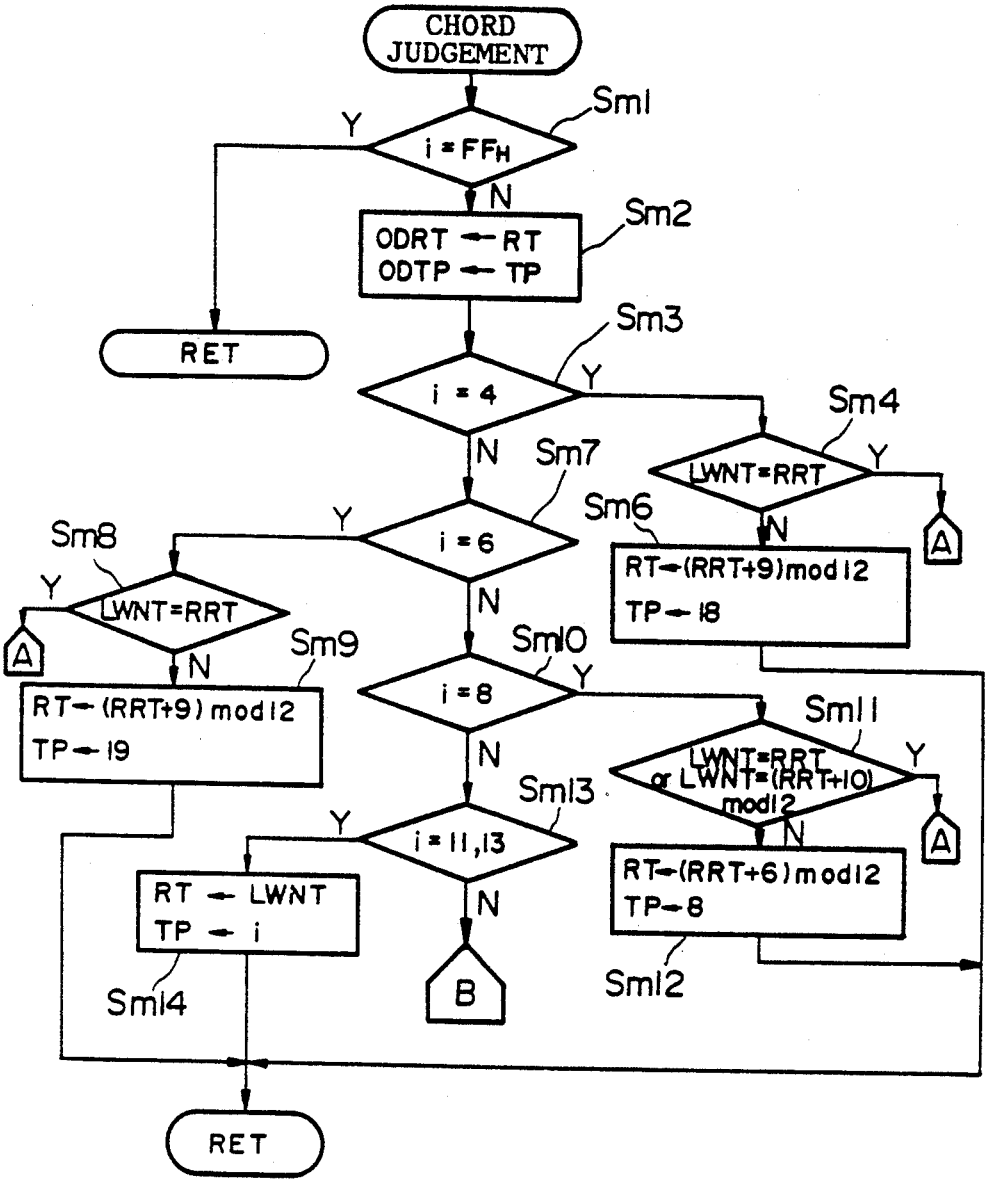
FIG.7 (CHORD JUDGEMENT ROUTINE -part I-)

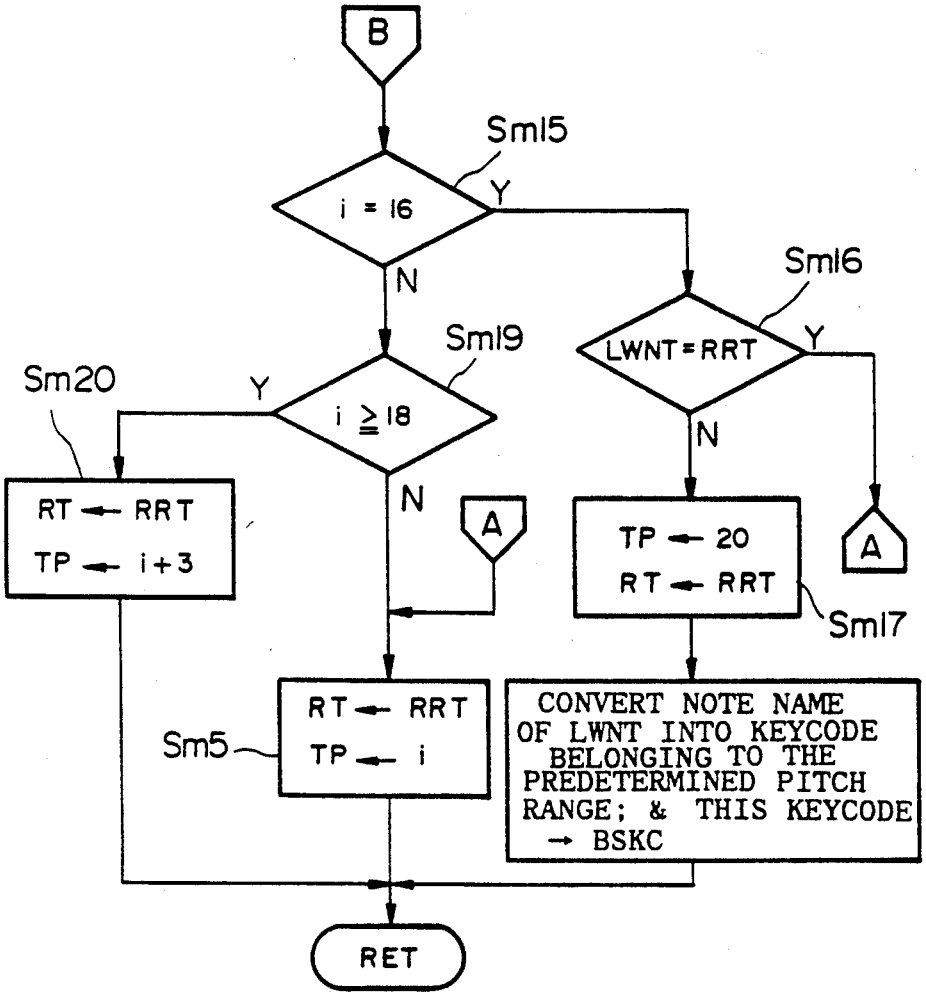
FIG.8 (CHORD JUDGEMENT ROUTINE -part II-)

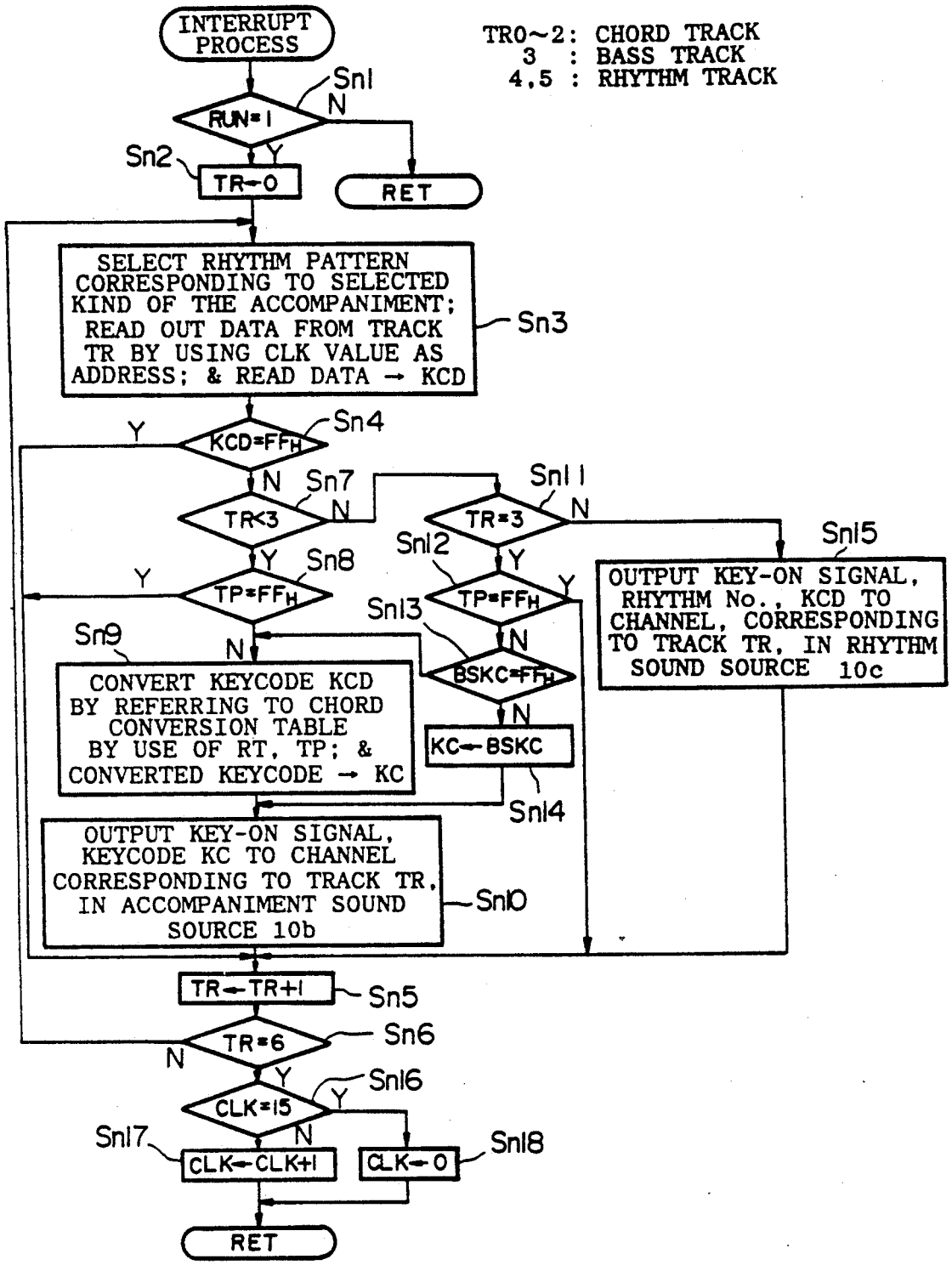
FIG.9 (INTERRUPT PROCESS ROUTINE)

AUTOMATIC ACCOMPANIMENT APPARATUS

BACKGROUND OF THE INVENTION

1. Field of the Invention

The present invention relates to an automatic accompaniment apparatus which is suitable for the electronic musical instrument such as the electronic piano.

2. Prior Art

As known well, the recent model of the electronic piano provides the automatic accompaniment apparatus. This automatic accompaniment apparatus is provided to assist the chord performance and bass performance. Herein, on the basis of the detection result of detecting the chord type and root of the performed chord, the chord and bass sounds are automatically generated at the predetermined timings. Particularly, there is developed an automatic accompaniment apparatus which plays the automatic accompaniment on the basis of the subharmonic chord (or fractional chord) to be detected. Incidentally, this subharmonic chord is defined as the chord which includes the chord note (or chord constituent note) and bass note each having the different root.

On the basis of plural pieces of pitch information which are produced responsive to the key-depression made by the performer, the above-mentioned automatic accompaniment apparatus detects the chord root of the subharmonic chord so as to compute the bass interval corresponding to the chord root and subharmonic chord. As a result, chord notes and bass notes of the subharmonic chord are to be sounded. This kind of technique is disclosed in Japanese Patent Laid-Open Publication No. 2-179690, for example.

Meanwhile, the above-mentioned conventional automatic accompaniment apparatus provides a pattern detection table, so that the chord can be detected by referring to this table. In this pattern detection table, each of the chord types each represented by twelve notes (e.g., C, C#, D, . . . , A#, B) is represented by 12-bit pattern data (hereinafter, referred to as chord pattern data), which are stored in the memory by the table-type format. Herein, data representing the mixture of the chord notes and bass notes are registered in this pattern detection table. In addition, only the simple subharmonic chords are registered in this table.

Therefore, when detecting the chord by use of the pattern detection table, the chord pattern is merely searched without distinguishing between the chord note and bass note in the chord to be designated. Therefore, the conventional apparatus forces to match the actually generated chord pattern with one of the limited number of the subharmonic chords registered in the table, thus regarding it as the detection result. For this reason, there is a drawback in that the accurate search cannot be made with respect to the subharmonic chords. In order to eliminate such drawback, a large number of tables must be provided to register complex patterns of the subharmonic chords. However, this increase the memory capacity which is required to store those tables.

SUMMARY OF THE INVENTION

It is accordingly a primary object of the present invention to provide an automatic accompaniment apparatus which can detect the subharmonic chord with accuracy and with small memory capacity to be required.

In one aspect of the present invention, there is provided an automatic accompaniment apparatus comprising: a pitch information creating means for creating plural pieces of pitch information in response to performance operation made by a performer; a pitch information extracting means for extracting first pitch information corresponding to chord notes of subharmonic chords and second pitch information corresponding to bass notes of those subharmonic chords from plural pieces of pitch information; a memory means for prestoring chord information; a chord detecting means for detecting a chord pattern representing the predetermined chord type in response to the chord information and first pitch information; and an automatic accompaniment means for automatically sounding a desirable subharmonic chord corresponding to the detected chord pattern and second pitch information.

BRIEF DESCRIPTION OF THE DRAWINGS

Further objects and advantages of the present invention will be apparent from the following description, reference being had to the accompanying drawings wherein the preferred embodiment of the present invention is clearly shown.

In the drawings:

FIG. 2 is a flowchart showing a main routine to be executed by the embodiment;

FIG. 3 is a flowchart showing a chord detection routine;

FIGS. 4 and 5 are flowcharts both showing a search routine;

FIG. 6 is a data table memorizing chord patterns or chord types in connection with roots;

FIGS. 7 and 8 are flowcharts both showing a chord judgement routine; and FIG. 9 is a flowchart showing an interrupt process routine.

DESCRIPTION OF THE PREFERRED EMBODIMENT

Figure 1:
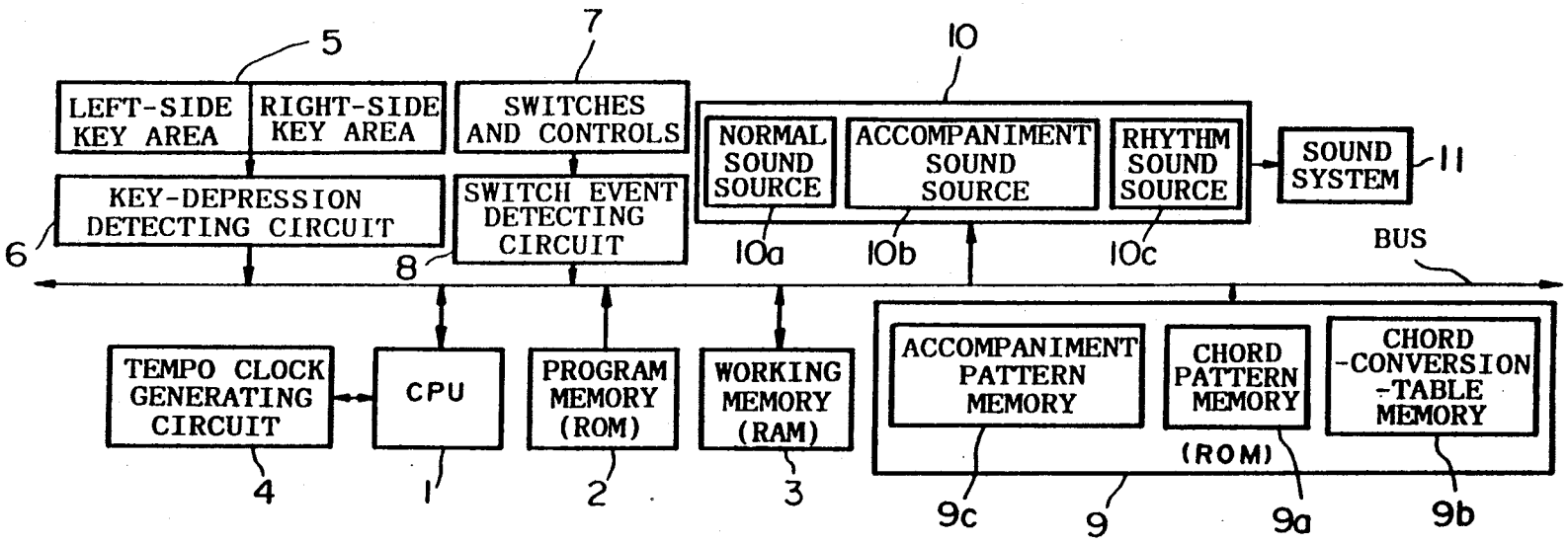
FIG. 1 is a block diagram showing an electric configuration of an automatic accompaniment apparatus according to an embodiment of the present invention.

Next, description will be given with respect to an embodiment of the present invention by referring to the drawings.

[A] Configuration

FIG. 1 is a block diagram showing the electric configuration of the automatic accompaniment apparatus according to an embodiment of the present invention. In FIG. 1, 1 designates a central processing unit (i.e., CPU) which controls musical tone generating processes on the basis of the signals supplied from several portions of this system, of which operations will be described later. In addition, 2 designates a program memory (which is configured as a read-only memory, ROM) which stores control programs to be loaded to the CPU 1. 3 designates a working memory (which is configured as a random-access memory, RAM) which is provided as a working area of the CPU 1 so as to temporarily store several kinds of arithmetic operation results and register data. 4 designates a tempo clock generating circuit which generates tempo clocks (i.e., tempo clock signal) representing the performance tempo of the automatic accompaniment, therefore, such tempo clocks are supplied to the CPU 1. In this automatic accompaniment to be performed by the present embodiment, the desirable chord notes and bass notes are automatically sounded responsive to the tempo clocks on the basis of the chords which are sequentially designated in accordance with the progress of the manual performance made by the performer, Incidentally, when the tempo clock signal is supplied to the CPU 1, the CPU 1 carries out the interrupt process by each clock period, thus playing the automatic accompaniment.

Further, 5 designates a keyboard of which whole key area is divided into two areas, i.e., left-side and right-side key areas, wherein designation of the chords is made by use of the keys of the left-side key area, while the melody performance is made by use of the keys of the right-side key area. 6 designates a key-depression detecting circuit which detects the key-depression event by scanning the on/off states of key switches (not shown) each provided for each of the keys in the keyboard 5. When detecting the key-depression event, this circuit 6 outputs a key-on signal. 7 designates several kinds of switches and controls (or manual-operable elements) which are arranged on the panel face (not shown). For instance, this portion 7 includes a start switch which is operated when starting the automatic accompaniment and a wheel-type pitch-bend control by which the pitch of the musical tone to be generated can be manually controlled. 8 designates a switch-event detecting circuit which detects a switch operation made in the manual-operable elements 7 so as to generate and output a switch-event signal. 9 designates data memories (each configured as ROM) which contains a chord pattern memory 9*a*, a chord-conversion-table memory 9*b* and an accompaniment pattern memory 9*c*. This chord pattern memory 9*a* stores detection pattern information P1 which is used to detect the chord. Incidentally, detailed description of this detection pattern information P1 will be made later. The chord-conversion-table memory 9*b* is configured as a data table by which in response to the chord type and root of the detected chord, each of the pitch information of the chord constituent notes is converted into the keycode corresponding to the predetermined pitch range. Further, the accompaniment pattern memory 9*c* stores the predetermined number of measures of pattern data by which tone-generation timings of the chord notes and bass notes are controlled in response to the foregoing tempo clocks. Herein, the pattern data corresponding to the rhythm kind designated by the manual-operable element 7 is read from this memory 9*c*.

Moreover, 10 designates a sound source which is designed in accordance with the known waveform memory read-out method, for example. This sound source 10 provides a normal sound source 10*a*, an accompaniment sound source 10*b* and a rhythm sound source 10*c*. By this accompaniment sound source 10*b*, the chord corresponding to the keycodes read from the foregoing chord-conversion-table memory 4*b* is generated at the tone-generation timing corresponding to the pattern data read from the accompaniment pattern memory 4*c*. 11 designates a sound system which amplifies musical tone signals outputted from the sound source 10 so as to generate the corresponding musical tones from speakers.

[B] Whole Operation

Next, description will be given with respect to the whole operation of the present embodiment by referring to the flowchart shown in FIG. 2.

When a power switch (not shown) is on, the CPU 1 uploads the control programs stored in the program memory 2, thus starting a main routine shown in FIG. 2, wherein the processing of the CPU 1 proceeds to first step Sa1. In this step Sa1, initialization is made so as to reset several kinds of registers and the like. In next step Sa2, it is judged whether or not the start switch is depressed on, wherein this start switch is depressed on (or operated) by the performer when starting the automatic accompaniment. In other words, it is judged whether or not the start switch on-event is detected. For example, when the start switch is operated, its on-event is detected, so that the judgement result of step Sa2 turns to "YES". Then, the processing proceeds to step Sa3 wherein contents of a register RUN is inverted. This register RUN stores the data representing the start/stop command of the rhythm performance. By inverting its bit value from "0" to "1", rhythm start is designated. In next step Sa4, the value "0" is set to a register CLK, and another value "FF" (represented by hexadecimal notation) is set to a register TP. Herein, the register CLK stores the data representing the accompaniment timing, while the register TP stores the chord type of the detected chord. Under the state where the chord type is not detected, the above-mentioned hexadecimal value "FF" is set to the register TP. In next step Sa5, the muting process is made to terminate the tone generation of the accompaniment sound source 10*b* and rhythm sound source 10*c*. Thereafter, the processing proceeds to step Sa6.

On the other hand, when the foregoing process of step Sa2 judges that the start switch is not operated, its judgement result turns to "NO", so that the processing branches to step Sa6. In step Sa6, it is judged whether or not the key-depression detecting circuit 6 outputs the key-on signal representing the key-depression event. If the key-on signal is detected, the judgement result of step Sa6 turns to "YES", and consequently the processing proceeds to step Sa7. In step Sa7, it is judged whether or not value of the register RUN is set at "1", in other words, it is judged whether or not the rhythm performance is started. In this case, if the on-event of the start switch is detected in the foregoing step Sa2, value of the register RUN must be set at "1", so that the judgement result of step Sa7 turns to "YES", and consequently the processing proceeds to step Sa8. In step Sa8, it is judged whether or not the depressed key belongs to the right-side key area of the keyboard 5. If the depressed key belongs to the left-side key area for designating the chords, the judgement result of this step Sa8 turns to "NO", so that the processing proceeds to step Sa9. In step Sa9, the CPU 1 carries out the chord detection process (of which contents will be described later) so as to detect the chord type and root of the chord designated by depressing the keys of the left-side key area.

In contrast, when the key-depression is made without operating the start switch, or when the start switch is operated but the chord is not designated by the keys of the left-side key area, the judgement result of step Sa7 turns to "NO" or the judgement result of step Sa8 turns to "YES". In each case, the processing proceeds to step Sa10 wherein the normal sound source 10*a* generates the musical tone signal corresponding to the keycode of the depressed key.

In short, the above-mentioned main routine performs the following operations.

(a) Start State

Under the start state, when the performer designates the chord by depressing the keys of the left-side key area, the present system detects the chord type and root of the designated chord, and then the automatic accompaniment is played on the basis of the detected chord type and root. On the other hand, when the melody is performed by using the keys of the right-side key area, the normal sound source 10*a* generates the musical tones corresponding to the keycodes of the depressed keys. Then, after executing the other processes of step Sa11, the processing returns to step Sa2 again, so that the foregoing processes of steps Sa2 to Sa11 are repeatedly executed.

(b) Non-Start State

Under the non-start state, the rhythm performance is not started, so that the chord detection is not made even if the performer depresses the keys of the left-side key area. Thus, tone-generation/muting process of the normal sound source 10*a* is only performed in response to the depressed keys of the right-side key area. After executing the other processes of step Sa11, the processing returns to step Sa2 again, and consequently the foregoing processes of steps Sa2 to Sa11 are repeatedly executed.

[C] Chord Detection Process

The present embodiment is characterized by the operations of this chord detection process, therefore, its detailed description will be made below.

This chord detection process consists of three routines, i.e., chord detection routine, search routine and chord judgement routine. Next, description will be given with respect to each of these routines in detail.

① Chord Detection Routine

When the processing of the CPU 1 proceeds to step Sa9 shown in FIG. 2, the chord detection routine shown in FIG. 3 is activated, so that the processing proceeds to first step Sb1. In step Sb1, on the basis of the key-on signal and keycode signal outputted from the key-depression detecting circuit 6, keycodes of all of the keys which is depressing in the left-side key area are inputted into a keycode array KC(i). Herein, "i" is set equal to the value representing ("number-of-depressed-keys" minus "1"), of which lowest value is zero. In step Sb2, the detected number of the depressing keys in the left-side key area is set at "N". In next step Sb3, the CPU 1 computes the value represented by "mod12" corresponding to the minimum value among values of the keycode arrays KC(0) to KC(N−1), wherein mode12 represents the remainder of the value divided by twelve. This computation offers the lowest-pitch note of the chord, which is set to a register LWNT. Then, after executing processes of the search routine (see step Sb4) and chord judgment routine (see step Sb5), the processing returns back to the foregoing main routine.

② Search Routine

In this routine, on the basis of the number N of the depressed keys in the left-side key area, the chord to be designated is detected. Hereinafter, description of this routine will be given with respect to each of four cases, i.e., cases of two-or-less key-depression, three key-depression, four key-depression and five-or-more key-depression.

(1) Two-or-Less Key-Depression

When the processing of the CPU 1 reaches step Sb4 shown in FIG. 3, the search routine as shown in FIGS. 4 and 5 is started, wherein the processing proceeds to its first step Sc1 shown in FIG. 4. In step Sc1, it is judged whether or not the foregoing key-depression number N, which is detected in the foregoing chord detection routine, is equal to or less than "2". In other words, it is judged whether or not the two or less keys are depressed. If so, the judgement result of this routine Sc1 turns to "YES", so that the processing proceeds to step Sc2. In step Sc2, it is judged that the chord cannot be formed because the key-depression concerns two or less keys, therefore, a search variable "i" is set at the hexadecimal value "FF". Then, the processing proceeds to step Sc3 shown in FIG. 5, wherein the lowest-pitch note set in the register LWNT is converted into the keycode belonging to the predetermined pitch range, and this keycode is set to a register BSKC.

As described above, in case of the two-or-less key-depression, it is judged that the chord cannot be formed, therefore, the keycode corresponding to the lowest-pitch note is generated as the bass note.

(2) Three Key-Depression

If three or more keys are depressed, the judgement result of step Sc1 turns to "NO", so that the processing branches to step Sc4. In step Sc4, the hexadecimal value "FF" is set to the register BSKC. This value "FF" set in the register BSKC indicates that the keycode of the bass note is not determined. In next step Sc5, it is judged whether or not the key-depression is made with respect to five keys. In this case, three keys are depressed, therefore, the judgement result of this step Sc5 turns to "NO". Thus, the processing proceeds to steps Sc6, Sc7, wherein the chord type and root of the chord to be designated are detected on the basis of the detection pattern information P1 stored in the chord pattern memory 9*a*.

By referring to FIG. 6, the detection pattern information P1 will be described. This detection pattern information P1 is given from a table CHDPT(i) which stores bit patterns, wherein each of these bit patterns indicates the chord pattern corresponding to the foregoing variable i by each degree (corresponding to each of twelve notes). In this table CHDPT(i), the pattern matching is carried out on the basis of the bit pattern corresponding to the keycode of the depressed key. For example, when three notes, i.e., 1° (do), 3° (mi), 5° (so), are depressed under the state where the tonic "C" is set as the root, major scale (i.e., "Maj") is detected as the chord type which coincides with the current bit pattern.

In the foregoing chord detection routine, the bit pattern is detected by referring to the table CHDPT(i) on the basis of three keycodes stored in the keycode arrays KC(0) to KC(2). In step Sc6 (see FIG. 4), the detected bit pattern is set to a register NBP (which is designed as the 12-bit register). In twelve bits of the data stored in the register NBP, "1" is set to each of the bits corresponding to the keycodes of the depressed keys, while "0" is set to each of the other bits. In next step Sc7, data bits of the register NBP are subjected to cyclic bit-shift in leftward direction, and the search operation is made to the table CHDPT(i) by sequentially incrementing the search variable i. Incidentally, such search operation is made under the known rotation method. As a result of the above-mentioned bit matching, a temporary root RRT is determined in response to the bit-shift times, and this root corresponds to the chord type detected by use of the bit pattern to be matched. Incidentally, this temporary root RRT can be computed by effecting "mod12" operation to the cyclic-bit-shift-times.

In step Sc8 (see FIG. 5), it is judged whether or not the matched bit pattern can be found by the search operation. If not found, the judgement result of step Sc8 turns to "NO", so that the processing proceeds to step Sc9. In step Sc9, it is judged whether or not the depressed-key-number N is equal to four. In the current case, three keys are depressed, therefore, the judgement result of step Sc9 is "NO", and consequently the processing proceeds to step Sc10. In step Sc10, the search variable i is set at "FF", indicating that there is no matched bit pattern. Then, this routine is ended.

On the other hand, if the matched bit pattern can be found, in other words, if the chord pattern is detected, the judgement result of step Sc8 turns to "YES", so that the processing branches to step Sc11. In step Sc11, it is judged whether or not the search variable i, indicating the matched bit pattern, is equal to or more than "18". In case of "i≧18", the currently designated chord is judged as the inharmonic chord as shown by the detection pattern information P1 (see FIG. 6). If the current chord does not correspond to this inharmonic chord, the judgement result of step Sc11 is "NO", then completing this routine. In contrast, if the current chord corresponds to the inharmonic chord, the judgement result of step Sc11 turns to "YES", therefore, the processing jumps to the foregoing step Sc3 wherein the lowest-pitch note within the notes corresponding to the depressed keys is set to the register BSKC as the keycode of bass note. Thereafter, this routine is completed.

As described above, in case of "three key-depression", the chord pattern and temporary root RRT are determined if the keycodes of the currently depressed keys can form the chord. If the current chord is the inharmonic chord, only the bass note of this chord is treated as the keycode based on its lowest-pitch note.

(3) Four Key-Depression

In case of this "four key-depression" wherein four keys are depressed, the judgement result of step Sc5 (see FIG. 4) is "NO", so that the processing proceeds to steps Sc6, Sc7. Thus, the chord type and temporary root RRT are searched for the current chord. If the matched chord type is found by the search operation, the judgement result of step Sc8 turns to "YES", so that the processing branches to the foregoing step Sc11. In step Sc11, it is judged whether or not the detected chord type is the inharmonic. Herein, the processings of this routine are ended if the detected chord type is the inharmonic, while the processing jumps to step Sc3 if the detected chord type is the inharmonic. In step Sc3, the lowest-pitch note within four notes corresponding to four depressed keys is set to the register BSKC as the keycode of bass note, and then this routine is ended.

On the other hand, if the judgement result of step Sc8 is "NO", indicating that the matched chord type cannot be found, the processing proceeds to step Sc9. In step Sc9, the judgement result turns to "YES" because four keys are depressed now, so that the processing proceeds to step Sc12. In step Sc12, detection of the bit pattern is made in accordance with three notes, wherein these three notes are selected by excluding the lowest-pitch note from four notes corresponding to four keycodes stored in the keycode arrays KC(0) to KC(3). Then, the detected bit pattern is set to the 12-bit register NBP. In data bits of this register NBP, "1" is set to each of the bits corresponding to the above-mentioned three notes, while "0" is set to each of the other bits. In next step Sc13, data bits of the register NBP are subjected to cyclic bit-shift in leftward direction, and the search operation is made to the table CHDPT(i) by sequentially incrementing the search variable i. As a result of this search operation, the temporary root RRT is determined in response to the bit-shift times, and the matched chord pattern is set as the chord type.

If the matched chord pattern is found in the above-mentioned process of step Sc13, the judgment result of step Sc14 turns to "YES", so that the processing jumps to the foregoing step Sc3. In this case, the lowest-pitch note within the foregoing three notes is set to the register BSKC as the keycode of bass note, and then this routine is ended. On the other hand, when the matched chord pattern cannot be found, the processing proceeds from step Sc14 to Sc10. In step Sc10, the search variable i is set at "FF", indicating that there is no chord pattern to be matched. Then, this routine is ended.

As described above, in case of "four key-depression", processes as similar to those of the foregoing case of "three key-depression" are made if the keycodes of four depressed keys can establish the chord. If these keycodes do not establish the chord, the chord detection is carried out again with respect to three notes which are obtained by excluding the lowest-pitch note from four notes. When the chord is detected from these three notes, chord notes are created in accordance with the detected chord, and its bass note is generated as the keycode based on the lowest-pitch note.

(4) Five Key-Depression

In case of five key-depression, the judgement result of step Sc5 turns to "YES", and consequently the CPU 1 carries out the processes as similar to those to be made if the chord is not established in case of the foregoing four key-depression. In short, the chord detection is carried out with respect to four notes which are obtained by excluding the lowest-pitch note from five notes corresponding to five depressed keys. Then, if the chord is detected from these four notes, the chord notes are created in accordance with the detected chord, and the bass note is generated as the keycode based on the lowest-pitch note.

③ Chord Judgement Routine

In the above-mentioned search routine, the chord pattern and temporary root RRT are determined by the pattern matching with respect to the chord which is detected in response to the depressed-key-nymber N. However, this pattern matching cannot distinguish the current chord between the common chord (or basic chord) and inverted chord. Therefore, this routine is provided to judge the true root RT and true chord pattern TP of the currently designated chord. Such chord judgement is made to the chord patterns shown in FIG. 6, particularly with respect to the search variable i at "4", "6", "8", "11", "13", "16" and "18" or more. In this chord judgement, in response to the pitch-relationship among the notes included in each chord pattern, it is judged whether the current chord is the common chord or inverted chord. For example, in case of the search variable i at "4", the currently designated chord is judged as the common chord if the designated lowest-pitch note is set as the root, so that the chord type TP thereof is judged as the sixth (6th). If not, the current chord is judged as the inverted chord, so that the chord type thereof is judged as the minor seventh (m7th).

Next, description will be given with respect to the processes of this chord judgement routine.

When the processing of the CPU 1 reaches at step Sb5 (see FIG. 3, indicating "chord judgement routine"), the CPU 1 starts to execute processes of the chord judgement routine as shown in FIGS. 7, 8. At first, the processing proceeds to step Sm1 wherein it is judged whether or not the search variable i is set at the hexadecimal value "FF". As described before, this search variable i is set when the matched bit pattern cannot be detected. Therefore, when the search variable i is set at "FF", it is impossible to perform the chord judgement, thus terminating this routine. On the other hand, if the search variable i is not equal to "FF", the judgement result of step Sm1 turns to "NO" so that the processing proceeds to next step Sm2. In step Sm2, the root RT and chord type TP are respectively set as an old root ODRT and an old chord type for the previous chord.

Thereafter, as described below, the chord judgement will be made with respect to each value of the search variable i.

(1) Chord Judgement at i=4

In the case where the search variable i is set equal to "4", judgement result of step Sm3 turns to "YES" so that the processing proceeds to step Sm4. In step Sm4, it is judged whether or not certain note of the chord, which is set to the register LWNT in the foregoing chord detection routine (see FIG. 3), coincides with the temporary root RRT. In other words, it is judged whether or not the temporary root RRT is the lowest-pitch note of the chord. If so, the judgement result turns to "YES", so that the processing branches to step Sm5 (see FIG. 8), wherein this temporary root RRT is judged as the true root RT, and value of the chord type TP is set at "4" (see table of FIG. 6), indicating the common chord of the sixth (6th). Then, this routine is ended.

In contrast, when the temporary root RRT is not the lowest-pitch note of the chord, the judgement result of step Sm4 turns to "NO" so that the processing proceeds to step Sm6. In step Sm6, the temporary root RRT is added with "9", and then the computation of mod12 is carried out on it so as to compute the true root RT. In addition, value of the chord type TP is set at "18" (see FIG. 6), indicating the inverted chord of "m7th".

(2) Chord Judgement at i=6

In the case where the search variable i is set equal to "6", judgement result of step Sm7 turns to "YES" so that the processing proceeds to step Sm8. In stem Sm8, it is judged whether or not the temporary root RRT is the lowest-pitch note of the chord. If so, the judgement result of step Sm8 turns to "YES", so that the processing branches to the foregoing step Sm5 (see FIG. 8). Herein, the temporary root RRT is judged as the true root RT, and value of the chord type TP is set at "6" (see FIG. 6), indicating the common chord of "m6th".

On the other hand, when the temporary root RRT is not the lowest-pitch note of the chord, the judgement result of step Sm8 turns to "NO", so that the processing proceeds to step Sm9. In step Sm9, this temporary root RRT is added with "9", and the computation of mod12 is carried out on it so as to compute the true root RT. In addition, value of the chord type TP is set at "19" (see FIG. 6), indicating the inverted chord of "m7th-5".

(3) Chord Judgement at i=8

In the case where the search variable i is set equal to "8", judgement result of step Sm10 turns to "YES", so that the processing proceeds to step Sm11. In step Sm11, it is judged whether or not the temporary root RRT is the lowest-pitch note of the chord, or it is judged whether or not the lowest-pitch note of the chord coincides with the computation result of "mod12" which is carried out on the value (RRT+10). If one of the above-mentioned two conditions is satisfied, the judgement result of this step Sm11 turns to "YES", so that the processing branches to the foregoing step Sm5 (see FIG. 8). Herein, the temporary root RRT is judged as the true root RT, and value of the chord type TP is set at "8" (see FIG. 6), indicating the common chord of "7th-5".

In contrast, when any one of the above two conditions is not satisfied, the judgement result of step Sm11 turns to "NO", so that the processing proceeds to step Sm12. In step Sm12, the temporary root RRT is added with "6" and the computation of mod12 is carried out on it so as to compute the true root RT. In addition, value of the chord type TP is set at "8", indicating the inverted chord of "7th-5".

(4) Chord Judgement at i=11, 13

In the case where the search variable i is equal to "11" or "13", judgement result of step Sm13 turns to "YES" so that the processing proceeds to step Sm14. In step Sm14, the lowest-pitch note memorized in the register LWNT is set as the root RT, while the value of the chord type TP is set at "11" (indicating the chord of "m6th-5") or "13" (indicating the chord of "M+5").

(5) Chord Judgement at i=16

In the case where the search variable i is equal to "16", judgement result of step Sm15 (see FIG. 8) turns to "YES", so that the processing proceeds to step Sm16. In step Sm16, it is judged whether or not the temporary root RRT coincides with the lowest-pitch note. If so, the judgement result of step Sm16 turns to "YES", so that the processing branches to step Sm5. Herein, this temporary root RRT is judged as the true root RT, and value of the chord type TP is set at "16", indicating the the suspended-four chord (i.e., "sus4" in FIG. 6). Then, this routine is ended.

On the other hand, if the temporary root RRT is not the lowest-pitch note, the judgement result of step Sm16 turns to "NO", so that the processing proceeds to step Sm17. In step Sm17, the temporary root RRT is judged as the true root RT, and value of the chord type TP is set at "20" (indicating the first-inversion-type chord, i.e., "inharmonic 4" in FIG. 6). In next step Sm18, value of the register LWNT is converted into the keycode which belongs to the predetermined pitch range, and then this keycode is set to the register BSKC as the bass note.

(6) Chord Judgement at i≧18

In the case where the search variable i is equal to or larger than "18", judgement result of step Sm19 (see FIG. 8) turns to "YES", so that the processing proceeds to step Sm20. In step Sm20, the temporary root RRT is set as the true root RT, and the chord type TP is searched by use of the search variable i added with "3", of which addition result ranges from "21" to "23" (indicating "inharmonic 1" to "inharmonic 3"). Then, this routine is ended.

④ Interrupt Process Routine

Meanwhile, the root and chord type TP, which are detected in the foregoing chord detection routine, are used to execute the interrupt process by each period of the tempo clock. As described later, in this interrupt process, the accompaniment sound source 10*b* and rhythm sound source 10*c* are driven so as to play the automatic accompaniment. Herein, the tempo clock signal, generated from the tempo clock generating circuit 4, is supplied to the CPU 1 by every ⅛ beat. By each period of this tempo clock signal, the CPU 1 starts to execute the interrupt process routine as shown in FIG. 9.

In first step Sn1 of this routine, it is judged whether or not the value "1" is set to the register RUN. In other words, it is judged whether or not the present system is in the rhythm start state. When the value "0" is set to this register RUN, the present system does not start the rhythm performance, therefore, the judgement result of step Sn1 is "NO". Then, this routine is ended. On the other hand, if the rhythm performance is started, the processing proceeds to step Sn2. In step Sn2, a track number TR of the playback track is reset to "0". Incidentally, the present embodiment provides five playback tracks, wherein tracks corresponding to the track number TR=0 to 2 are called "chord tracks"; track corresponding to TR=3 is called "bass track"; and tracks corresponding to TR=4, 5 are called "rhythm tracks". In next step Sn3, the CPU 1 selects the rhythm pattern corresponding to the selected kind of the accompaniment. In addition, by using the value of the supplied tempo clock signal as the address, the CPU 1 reads out the data from the playback track designated by the track number TR, and the read data is set as a keycode KCD. In step Sn4, it is judged whether or not this keycode KCD coincides with the hexadecimal value "FF". If the keycode KCD coincides with "FF", the judgement result of step Sn4 turns to "YES" so that the processing proceeds to step Sn5 wherein the current track number TR is incremented by "1". In next step Sn6, it is judged whether or not the incremented track number TR becomes equal to "6", in other words, it is judged whether or not the data of all tracks have been played back. Until all tracks are played back, the playback operation is carried out as follows.

(1) Playback Operation of Chord Track

When the keycode KCD is not at "FF" and the track number TR is smaller than "3", the judgement result of step Sn7 turns to "YES", so that the playback operation is carried out with respect to the chord tracks.

In this case, the processing proceeds to step Sn8 wherein it is judged whether or not the chord type TP is set at "FF", in other words, it is judged whether or not the chord type TP is detected in the foregoing chord detection routine. If the chord type TP is not detected, the judgement result of step Sn8 turns to "YES", so that the processing branches to the foregoing step Sn5 wherein the track number TR is incremented by "1". On the other hand, if the chord type TP is detected, the judgement result of step Sn8 turns to "NO" so that the processing proceeds to step Sn9. In step Sn9, on the basis of the detected root RT and chord type TP of the chord, the keycode KCD read from the chord track is converted into the keycode KC by referring to the foregoing chord conversion table. In next step Sn10, this keycode KC and the foregoing key-on signal are both supplied to the accompaniment sound source 10*b*. As a result, the accompaniment sound source 10*b* generates the musical tone signal concerning the chord from its channel corresponding to the current chord track. Thus, the accompaniment can be made by use of the chords.

(2) Playback Operation of Bass Track

This playback operation is started when the judgement result of step Sn11 is "YES", i.e., when the track number TR becomes equal to "3". In this case, the processing proceeds to step Sn12 wherein it is judged whether or not the chord type TP is set at "FF", in other words, it is judged whether or not the chord type TP is detected in the foregoing chord detection routine. If the chord type TP is not detected, the judgement result of step Sn12 turns to "YES", so that the processing branches to step Sn5 wherein the track number TR is incremented by "1". On the other hand, if the chord type TP is detected, the judgement result of step Sn12 turns to "NO" so that the processing proceeds to step Sn13 wherein it is judged whether or not the bass note is detected.

In the case where the bass note is not detected, the judgement result of step Sn13 is "YES", so that the processing proceeds to steps Sn9 and Sn10. In this case, the key-on signal and keycode KC is supplied to the accompaniment sound source 10*b*. As a result, the accompaniment sound source 10*b* generates the musical tone signal concerning the bass note from its channel corresponding to the bass track.

In contrast, if the bass note is detected, the judgement result of step Sn13 turns to "NO" so that the processing proceeds to step Sn14 wherein the bass note stored in the register BSKC is set as the keycode KC. Then, the processing proceeds to step Sn10, resulting that the accompaniment sound source 10*b* generates the musical tone signal concerning the bass note from its channel corresponding to the bass track.

(3) Playback Operation of Rhythm Track

When the judgement result of step Sn11 is "NO", indicating that the track number TR is larger than "3", the processing branches to step Sn15, so that this playback operation is to be carried out. In step Sn15, the keycode KCD, the key-on signal outputted from the key-depression detecting circuit 6 and the rhythm kind set by the manual-operable element 7 are all supplied to the rhythm sound source 10*c*. As a result, the rhythm sound source 10*c* generates the musical tone signal concerning the rhythm from its channel corresponding to the rhythm track. Incidentally, such rhythm sounds are generated, regardless of the chords to be detected.

After completing the above-mentioned three playback operations (1) to (3), the judgement result of step Sn6 turns to "YES", so that the processing proceeds to step Sn16. In step Sn16, it is judged whether or not the value of the register CLK is equal to "15". If not, the processing proceeds to step Sn17 wherein the value of the register CLK is incremented by "1". In contrast, when the value of the register CLK is at "15", it is reset to zero in step Sn18. Then, this routine is ended.

As described heretofore, when detecting the chord in response to the key-depression number in the left-side key area, the present embodiment searches the bass note and chord constituent notes respectively and independently. Thus, it is possible to accurately detect the subharmonic chord with relatively small memory capacity for storing the table.

[D] Modifications

The present embodiment can be modified as follows.

(1) The embodiment is designed to generate the bass note corresponding to the lowest-pitch note and also generate the chord constituent notes based on the other notes. Instead, it is possible to employ the other methods. For example, the embodiment can be modified such that the bass note and chord constituent notes are separated from the notes designated by the performer in response to the tone color of the musical tones to be generated. Or, the bass note and chord constituent notes are separated from the designated notes in response to the tone-generation channel of the sound source to be used.

(2) If the above-mentioned methods are employed, of course, it is possible to use the chord patterns other than those used in the present embodiment.

Lastly, this invention may be practiced or embodied in still other ways without departing from the spirit or essential character thereof as described heretofore. Therefore, the preferred embodiment described herein is illustrative and not restrictive, the scope of the invention being indicated by the appended claims and all variations which come within the meaning of the claims are intended to be embraced therein.

What is claimed is:

1. An automatic accompaniment apparatus comprising:

a pitch information creating means for creating plural pieces of pitch information in response to performance operations;

a pitch information extracting means for extracting first and second pitch information from said plural pieces of pitch information, wherein said first pitch information corresponds to chord constituent notes of a subharmonic chord to be designated by a performer, while said second pitch information corresponds to a bass note of the subharmonic chord;

a memory means for pre-storing chord information;

a chord detecting means for detecting a desirable chord pattern from predetermined chord patterns corresponding to said chord information in response to said first pitch information; and an automatic accompaniment means for determining a desirable subharmonic chord on the basis of said desirable chord pattern and said second pitch information so as to automatically sound said desirable subharmonic chord as the accompaniment.

2. An automatic accompaniment apparatus as defined in claim 1 wherein said pitch information creating means corresponds to a left-side key area of a keyboard to be normally performed by a left hand of a performer, so that the pitch information concerning chords is created on the basis of number of depressed keys in the left-side key area.

3. An automatic accompaniment apparatus as defined in claim 1 wherein said memory means pre-stores said chord information in form of a data table storing predetermined chord types corresponding to said chord patterns in connection with roots, so that said chord detecting means selects desirable one of said chord types on the basis of a root which is selected from notes designated by the performer in accordance with said first pitch information.

4. An automatic accompaniment apparatus as defined in claim 3 wherein the predetermined chord types include common chords and inversion-type chords, wherein one of the common chords is selected when the root is the lowest-pitch note within the notes designated by the performer, while one of the inversion-type chords is selected when the root is not the lowest-pitch note.

* * * * *